US006827431B2

(12) United States Patent
Kitabatake et al.

(10) Patent No.: US 6,827,431 B2
(45) Date of Patent: Dec. 7, 2004

(54) INK TANK

(75) Inventors: Kenji Kitabatake, Kanagawa (JP); Yasuo Kotaki, Kanagawa (JP); Keisuke Matsuo, Kanagawa (JP); Wataru Takahashi, Kanagawa (JP); Hiroki Hayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/134,542

(22) Filed: Apr. 30, 2002

(65) Prior Publication Data

US 2002/0167575 A1 Nov. 14, 2002

(30) Foreign Application Priority Data

May 10, 2001 (JP) ..... 2001-139974
Apr. 19, 2002 (JP) ..... 2002-117523

(51) Int. Cl.[7] ..... B41J 2/17; B41J 2/175
(52) U.S. Cl. ..... 347/86; 347/84; 347/85
(58) Field of Search ..... 347/84, 85, 86

(56) References Cited

U.S. PATENT DOCUMENTS 5,182,581 A * 1/1993 Kashimura et al. ..... 347/87
5,657,065 A * 8/1997 Lin ..... 347/93
5,774,773 A * 6/1998 Otsuka et al. ..... 399/262
5,953,030 A * 9/1999 Ishinaga et al. ..... 347/86
6,068,371 A * 5/2000 Wallace et al. ..... 347/86
6,293,663 B1 9/2001 Koshikawa et al. ..... 347/86
6,334,674 B1 1/2002 Ono et al. ..... 347/86
6,345,889 B1 * 2/2002 Sakuraoka et al. ..... 347/86
2002/0109759 A1 * 8/2002 Usui et al. ..... 347/86

FOREIGN PATENT DOCUMENTS

| | | | |
|---|---|---|---|
| EP | 779157 | 6/1997 | |
| EP | 779157 A2 * | 6/1997 | ..... B41J/2/175 |
| EP | 960732 | 12/1999 | |
| EP | 1095777 | 5/2001 | |
| JP | 8-90783 | 4/1996 | |
| JP | 11-138836 | 5/1999 | |

* cited by examiner

*Primary Examiner*—Lamson Nguyen
*Assistant Examiner*—Leonard Liang
(74) *Attorney, Agent, or Firm*—Fitzpatrick, Cella, Harper & Scinto

(57) ABSTRACT

An ink tank comprises a housing and a cover member, providing a hollow containing portion when bonded together, and in this containing portion, ink absorbent formed by laminating fiber material is contained. On the cover member, a rib is provided to extrude into the containing portion. This rib comprises a first directional rib arranged diagonally to the fibrous lamination face of the ink absorbent, and a second directional rib that intersects with the first directional rib orthogonally. On the position surrounded by the first directional rib and the second directional rib, an atmosphere communication port is formed, and around the atmosphere communication, the communication port guide that extrudes into the containing portion is arranged. The height of the rib is larger than that of the communication port guide. The rib presses the ink absorbent without being buried in it. With the rib thus structured, it is possible to enhance the use efficiency of ink in the ink tank, while preventing ink from leaking externally, and the rib from being broken as well.

4 Claims, 8 Drawing Sheets

INK TANK

BACKGROUND OF THE INVENTION

1. Field of the Invention

The present invention relates to an ink tank used for an ink jet recording apparatus.

2. Related Background Art

The ink jet recording apparatus is a recording apparatus of the so-called non-impact type, which is capable of recording on various recording mediums at high recording speed. Also, with the advantage, among some others, that almost no noise occurs at the time of recording, it is widely used. The ink jet recording apparatus of the kind performs recording on a recording medium by discharging fine ink droplets from minute nozzles, and it has, in general, an ink jet head provided with nozzles for discharging ink droplets and an ink tank that retains ink to be supplied to the ink jet head.

The conventional ink tank used for the ink jet recording apparatus is structured to adjust pressure exerted on ink in order to keep the ink supply from the ink tank to the ink jet head in good condition. For example, the structure is arranged to contain ink absorbent in the ink tank. When the ink tank having ink absorbent contained therein, it is arranged to keep ink in the ink jet head not to fall off from the ink discharge ports by holding the ink absorbent always in the negatively pressurized condition after taking into consideration the difference of water heads of the ink liquid surfaces in the ink discharge ports of the ink jet head and the ink tank. When the discharge energy is applied to ink, it is arranged to prevent ink from flowing out of the ink jet head excessively, and control to discharge only an appropriate amount of ink from the ink jet head. Also, after ink is discharged from the ink jet head, ink retained in the ink absorbent is carried to the ink jet head. However, in order not to allow ink to flow in continuously without any limit, ink is drawn to the ink absorbent appropriately by means of the negative pressure exerted in the ink absorbent. In this manner, pressure exerted on ink in the ink tank and ink jet head is adjusted by use of the ink absorbent.

FIG. 9 is a perspective view that shows the section of the conventional ink tank. As shown in FIG. 9, an ink absorbent 120 is contained in the containing portion of the ink tank 110. A foaming element, such as urethane sponge, forms the ink absorbent 120. Also, on the wall face of the containing portion of the ink tank 110, plural ribs 101 are formed to extrude perpendicularly from the wall face. Each leading end of the plural ribs 101 is in contact with the ink absorbent 120 to secure the space that becomes each air passage 15 between the wall face having the ribs 101 formed thereon and the ink absorbent 120. In this way, the air is evenly carried to the containing portion of the ink tank 110 through each of the air passages 15 thus secured to make it possible to use ink retained in the ink absorbent 120 efficiently. Also, the ribs 101 are in contact with the ink absorbent 120 to compress the ink absorbent 120, thus presenting an appropriate negative condition.

As shown in FIG. 9, there often utilized a foaming element, such as urethane sponge, for the ink absorbent 120 contained in the conventional ink tank 110. However, depending on the nature of ink to be used, the urethane sponge or some other foaming element chemically reacts upon ink when it is kept for a long time, and in some cases it is not necessarily suitable for use. In recent years, therefore, instead of the foaming element, such as urethane sponge, a laminated fibrous element, which is formed by material having preferably suitable ink preserving property, is sometimes used as the ink absorbent.

FIG. 10 is a perspective view that shows the ink tank 110 that contains the fibrous ink absorbent 121 (hereinafter abbreviated as an ink absorbent), which is formed by a lamination of plural sheet type fibrous element formed by thermally forming the laminated fibrous element, in place of the foaming element, such as urethane sponge.

On the wall face of the ink tank 110 shown in FIG. 10, the ribs 101, which are similar to those shown in FIG. 9, are arranged. In other words, the ribs 101 that extend in the direction parallel to the laminated surface of the fibrous ink absorbent 121. In this case, each of the ribs 101 tends to be buried as shown in FIG. 10 as it enters the absorbent as if inserted into the gap of laminated fibrous material of the ink absorbent 121, because the ribs 101 are in parallel to the laminated surface of the fibrous ink absorbent 121. If the status becomes such as this, any sufficient air passage cannot be secured in the containing portion of the ink tank 110. As a result, the air cannot be carried evenly into the containing portion of the ink tank 110 any more. Also, it becomes difficult for the ribs 101 to secure the condition of pressurized contact with the ink absorbent 121, thus making it uneasy to generate designated negative pressure. Consequently, it often invites the condition that the ink use efficiency of the ink tank 110 is made lower.

On the other hand, FIG. 11 is a perspective view that shows the ink tank 110, which is in a state that as compared with the ink tank shown in FIG. 10, the direction of ribs 101 is rotated at 90 degrees or the direction of fibrous lamination arrangement is rotated at 90 degrees. In other words, on the wall face of the containing portion of the ink tank 110 shown in FIG. 11, the ribs 101 are formed in the direction intersecting with the fibrous lamination surface of the ink absorbent 121.

With the structure thus arranged, such ribs 101 as shown in FIG. 10 do not enter the fibrous lamination surface of the ink absorbent 121 as if inserted along it into the absorbent. Therefore, the air passages 150 can be secured. Nevertheless, there is a tendency that the ink absorbent 121 swells between ribs 101 and 101, and such swelling portions of the ink absorbent 121 approach the wall face of the containing portion eventually. In this case, a part of the ink absorbent 121 is allowed to approach the inner opening of the atmosphere communication port 102, which is communicated with the air passage 150 formed on the wall face to extruded, and which enables the interior of the ink tank to be communicated with the air outside. Then, there is a fear that ink leaks to the outside of the ink tank 110 from the atmosphere communication port 102 due to various causes, such as external vibration, environmental changes, or the like if ink retained in the ink absorbent 121 should exist too closely thereto.

Also, the air passage 150 functions as a buffer pace that temporarily holds ink leaking from the ink absorbent 121 when the ink tank 110 is affected by the environmental changes, such as temperature or pressure changes, and prevents it from leaking to the outside of the ink tank 110 immediately. However, if the ink absorbent 121 swells between ribs 101 and 101 to reduce the volume of the buffer space to make the function of the buffer space insufficient. Then, there is a possibility to allow ink leakage from the atmosphere communication port 102 easier.

In addition, the edge portion of the ink absorbent 121 (near the contact portion with the side face of the ink tank) is caused to swell greater than the other portions (in an image of springing up) depending on the positions of the ribs 101 thus arranged, and there is a possibility to invite such event as the edge portion is in contact with the upper face of the ink tank 110. This may become a cause of ink leakage under such circumstance. Therefore, it is required more that ribs 101 should be arranged closer to the side face of the ink tank 110.

As described above, if ribs 101 should be arranged so as to suppress the selling of the ink absorbent 121 in various locations, intervals between ribs 101 are made narrower eventually, and the resultant buffer spaces formed by the ribs 101 become smaller to make it impossible to demonstrate the buffer function sufficiently. Then, there is a possibility that this becomes a cause of ink leakage. Here, it may be possible to make the volume dedicated for containing the ink absorbent 121 smaller in order to secure the buffer space or make the volume of the tank itself larger to counteract this situation, but this solution is wrong, because the relative importance of the subject is neglected.

Also, for the conventional ink tanks each shown in FIG. 9 to FIG. 11, the ribs 101 are arranged in the form of extending thinly from the wall face of the containing portion. Therefore, the ribs are ease to fall down, and there is a possibility that unless some reinforcement structure is provided, ribs 101 are broken when the ink tank 110 is manufactured: particularly, in the process of welding by use of ultrasonic welding, stress is concentrated on the ribs 101, for example. Also, after manufacture, there is a fear that the ribs 101 are broken in the worst case due to the reaction of the ink absorbent that always acts upon the ribs 101.

SUMMARY OF THE INVENTION

Now, in consideration of the problems encountered in the conventional art as described above, the present invention is designed. It is an object of the invention to provide an ink tank having excellent capability of retaining and supplying ink (retaining efficiency and use efficiency), which is capable of suppressing the burying of ribs into ink absorbent when the ink absorbent is formed by laminating fibers and contained in the containing portion of the ink tank, while securing the air passage of the containing portion, as well as keeping the gap (buffer space) between an atmosphere communication port and the ink absorbent appropriately, for the enhancement of ink use efficiency, and also, for the prevention of ink leakage and breakage of ribs.

In order to achieve the object described above, the ink tank of the invention comprises a containing portion for containing an ink absorbent formed by laminated fiber material, and a rib extruding into the interior of the containing portion. For this ink tank, the rib comprises a first directional rib extending diagonally in the direction parallel to the fibrous lamination face of the ink absorbent, and a second directional rib intersecting with the first directional rib.

On the wall face where the rib is formed, an atmosphere communication port may be provided for supplying the air into the interior of the containing portion. Then, it is preferable to provide a guide extruding from the wall face on the circumference of the atmosphere communication port. Further, in this case, it is preferable to make the height of the rib larger than that of the guide.

It is preferable to form the ink absorbent by polypropylene or polyethylene.

Also, the ink tank of the invention, which is detachably mountable on an ink jet head for retaining ink to be supplied to the ink jet head, comprises an ink absorbent structured by laminating fiber material; a containing portion for containing the ink absorbent; an atmosphere communication port for enabling the interior of the ink tank to be communicated with the air outside; and an ink supply port communicated with the ink jet head for supplying ink. For this ink tank, a rib is provided for the side face having the atmosphere communication portion arranged, which comprises a first directional rib diagonally crossing the laminating direction of the fiber material of the ink absorbent, and a second directional rib intersecting with the first directional rib and diagonally crossing the laminating direction of the fiber material of the ink absorbent, and extrudes into the interior of the containing portion.

DESCRIPTION OF THE PREFERRED EMBODIMENTS

Next, with reference to the accompanying drawings, the description will be made of the embodiments in accordance with the present invention.

Figure 1:
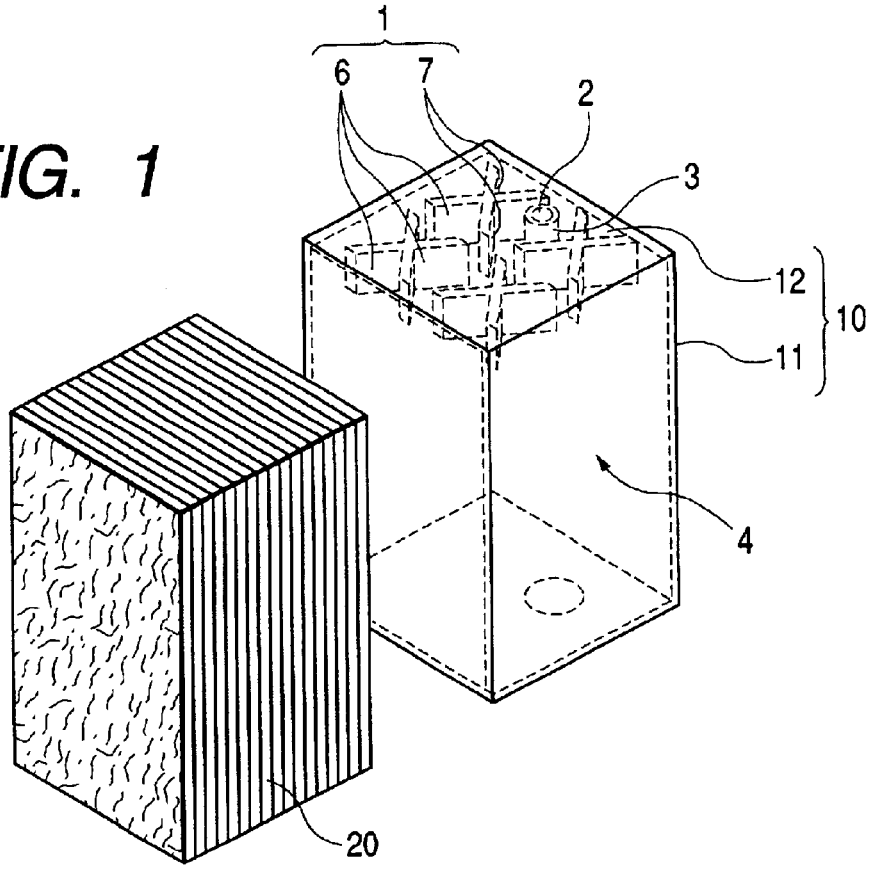
FIG. 1 is an exploded perspective view that shows an ink tank in accordance with one embodiment of the present invention.

FIG. 1 is an exploded perspective view that shows an ink tank in accordance with one embodiment of the present invention. This ink tank is such that a cover member 12 is installed on a housing 11 to form a hollow ink tank case 10, and that in the ink tank case 10, the containing portion 4 is formed to contain ink absorbent 20. The laminated fibrous material forms the ink absorbent 20. FIG. 1 shows the state where the ink absorbent 20 is drawn out of the ink tank case 10. The ink absorbent 20 has the outer shape that is slightly larger than the ink tank case 10. The ink absorbent 20 is contained in the ink tank case 10 in a state of being compressed.

Now, the description will be made of the fibrous laminated member. The fibrous laminated member is such that the web (fiber), the fibrous direction of which is substantially uniform, is laminated, and by use of a carding machine (not shown), a cross layer machine (not shown), or the like, the fibrous laminated member is manufactured in a designated target amount, and cut out in a desired size. The fibrous web is laminated in such a way that the laminated face is in parallel to the direction of weight when the ink tank is in use. In FIG. 1 and each of the drawings to follow, the laminated surface is shown in solid lines. The direction of fiber in the web is substantially perpendicular to the direction in which the webs are laminated (in FIG. 1, the fibrous direction is almost uniform in the direction from the top to the bottom). For the present embodiment, the sheet type or web type lamination member, which is manufactured by use of a card machine, a cross layer machine, or the like as described above, is cut out in almost square of approximately 1,000 mm×1,000 mm to form the fibrous lamination member to be use as the ink absorbent 20. Here, it is desirable to make the density of the fibrous material almost uniform in the fibrous lamination member.

For the present embodiment, the double structured core-case fiber, which is formed by the core portion formed by polypropylene (PP) and the case portion formed by polyethylene (PE) surrounding the core portion, is used as the fibrous material that forms the fibrous lamination member. The fusion point of polypropylene is approximately 180° C. and the fusion point of polyethylene is approximately 130° C. Therefore, the fusion-point difference between them is approximately 50° C. Generally, the fibrous material having the fiber diameter of approximately 5 $\mu$m to 5 $\mu$m is used. For the present embodiment, the fibrous material of approximately 30 $\mu$m (6 deniers) is used.

Figure 2:
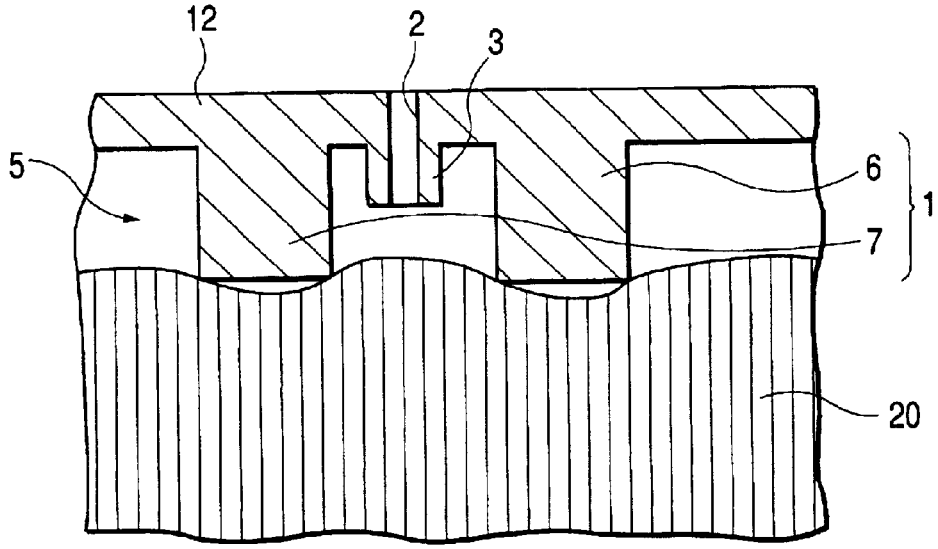
FIG. 2 is an enlarged sectional view that shows the principal part of the ink tank represented in FIG. 1.

On the inner face of the cover member 12, which forms one wall face of the containing portion 4 of the ink tank case 10, there is formed a rib 1, which extrudes vertically into the interior of the containing portion 4. Although described in detail later, a first diagonally directed directional rib 6, which diagonally crosses the laminating direction of the fibrous lamination member, and a second directional rib 7 substantially orthogonal to the first directional rib 6 constitute this rib 1. The first directional rib 6 and the second directional rib 7 are formed to intersect with each other. The cover member 12 is provided with the atmosphere communication port 2 on the position surrounded by the first directional rib 6 and the second directional rib 7. On the inner circumferential edge of the atmosphere communication port 2, there is arranged the communication port guide 3, which extrudes to the inner side, surrounding the atmosphere communication port 2. As shown in FIG. 2, which is a cross-sectional view that illustrates the vicinity of the atmosphere communication port, the height (length of the extrusion) of the communication port guide 3 is smaller than the height (length of the extrusion) of the rib 1.

In the containing portion 4 inside the ink tank case 10, which is structured by installing the cover member 12 on the housing 11, the ink absorbent 20, which is the aforesaid fibrous lamination member, is contained. The ink absorbent 20 absorbs and retains ink, thus containing and retaining ink in the ink tank.

The ink absorbent 20 is inserted so that the rib 1 is in contact under pressure with the face where the edge face of web of the fiber material is aligned. For the present embodiment, the density of the ink absorbent 20 is 0.06 g/cm$^3$ to 0.1 g/cm$^3$ before it is inserted into the ink tank case 10. However, when the ink absorbent 20 is inserted into the ink tank case 10, the rib 1 presses it to be compressed, and the density thereof becomes 0.08 g/cm$^3$ to 0.15 g/cm$^3$ after insertion.

The space where the rib 1 exists between the ink absorbent 20 and the cover member 12 is the air passage 5 where the air can flow. The air passage 5 enables the air to flow around on the upper face of the ink absorbent 20 in good condition in accordance with the consumption of ink. Then, it stabilizes the condition of ink consumption, while functioning as the buffer space that temporarily holds ink leaking from the ink absorbent 20 when the ink tank is affected by the environmental changes, such as temperature or atmospheric changes.

For example, the buffer space, which functions to prevent ink leakage from the atmosphere communication port 2 even when the atmosphere communication port 2 is directed directly below and left intact in such posture, is the space regulated by the inner wall face of the cover member 12 where the rib 1 is formed, and the height (extrusion) of the communication port guide 3. If the height (extrusion) of the communication port guide 3 is made larger in order to make this space larger, the gap between the ink absorbent 20 and the leading end of the communication port guide 3 becomes smaller. As a result, even the ink that slightly overflows from the ink absorbent 20 enters the communication port guide 3 that exists nearer. Thus, there is a possibility that ink leakage occurs to the outside from the atmosphere communication port 2. Therefore, it is not desirable to make the height (extrusion) of the communication port guide 3 too large. Also, the ink absorbent 20 swells between ribs 1, and approaches the communication port guide 3. In order to reduce the amount of this swelling, the gap between ribs may be made narrower for the purpose. Then, the distance between rib 1 and the communication port guide 3 becomes smaller, and there is a fear that ink tends to be drawn into the communication guide port 3 due to the meniscus of ink that is formed between the rib 1 and the communication port guide 3. To suppress the swelling effectively, it is advisable to surround the rib in the equal distance from the communication port guide 3 as much as possible. However, with the ink absorbent being formed by the fibrous lamination member, the rib 1 pierces it in the direction of fiber lamination if the surrounding rib 1 has its component parallel to the direction of fiber lamination. The parallel component of the rib does not demonstrate the function to press the ink absorbent.

Also, with the existence of rib 1 on the inner wall face of the cover member 12, the buffer space becomes smaller by the portion equivalent to the volume of the rib 1, thus reducing the margin with respect to ink leakage. Therefore, it is desirable to make the volume of rib 1 (the total volume of ribs) as small as possible. (For example, the numbers of ribs should be reduced or it is required to make the thickness of ribs smaller if the numbers of ribs should be increased.) Also, if the contact portion between the rib 1 and the ink absorbent 20 should be large, there is a fear that unevenness takes place in the ink distribution in the ink absorbent 20. For example, in the vicinity of the contact portion with the rib 1, the ink absorbent 20 is compressed more strongly than the one in the other portions, which are farther away from the contact portion. As a result, there is a possibility that it becomes difficult for such portion to absorb ink or the reduction of ink in such portion is slower in the process of consuming ink retained by the ink absorbent 20 as compared with the portions away from the contact portion. Therefore, in order to eliminate the uneven reduction of ink for the enhancement of use efficiency of ink, it is preferable to make the rib 1 smaller to reduce the contact portion thereof with the ink absorbent 20.

However, if the rib 1 is made too small, it becomes to press the ink absorbent 20 as if at each point, for example, and it is conditioned to pierce the ink absorbent eventually.

The function of the rib 1 to regulate the position of the ink absorbent 20 is reduced, and there is a possibility that the ink absorbent 20 is displaced by shocks due to dropping of the ink tank or the like. Further, if the rib 1 is made too small, the ink absorbent 20 tends to be deformed easily, and the ink absorbent 20 is deformed so as to approach the inner wall face of the cover member 12, thus making the buffer space smaller. There is a fear, then, that the margin is made smaller still with respect to ink leakage.

In consideration of the aforesaid situations, the inventers hereof have urgently made researches and experiments. As a result, it is found that if the rib 1 is arranged so as to intersect with the fibrous lamination face (web lamination face) of the ink absorbent 20 diagonally to the direction parallel thereto, the fear that the ribs enter and pierce the ink absorbent 20 or to be buried therein becomes smaller than the case where the rib 1 of the same size is arranged in the direction parallel to the fibrous lamination face. Also, as described later, if the ribs are structured only in the direction perpendicular to the fibrous lamination face, it becomes difficult to secure rigidity of ribs.

Now, therefore, for the present embodiment, the rib 1 is arranged so that the angle formed to the direction parallel to the fibrous lamination face of the ink absorbent 20 is 45 degrees. Further, as compared with the case where only the ribs extending in one direction are extruded from the inner wall face of the cover member, the rigidity of rib 1 becomes higher, because intersecting points are provided by the structure that enables ribs extending in different directions to intersect with each other. In accordance with the present invention, the first directional rib 6, which is arranged to make the angle of 45 degrees to the direction parallel to the fibrous lamination face of the ink absorbent 20 as described earlier, and the second rib 7 orthogonal to the first directional rib 6 are structured to intersect with each other. In this manner, even if the rib 1 is thin, it is possible to keep high rigidity, and in the welding process in which the cover member 12 is welded to the housing 11 by means of ultrasonic welding, for example, at the time of manufacture, it becomes possible to prevent the rib 1 from being damaged by the concentrated stress. Further, with the rigidity of the rib 1 that is made high and secured by the structure thus arranged, it becomes possible to prevent the rib 1 from being damaged by the reaction of the ink absorbent 20 exerted on the rib 1 after manufacture.

Also, against the condition that the edge portion of the ink absorbent 20 (near the side face of the ink tank case) leaps up, the cross-ribs structure makes it possible to essentially press the edge portion of the ink absorbent 20 exactly, because as shown in FIG. 1, for example, the edge portions of the cross ribs are arranged at designated intervals even if the entire edge portions of the ink absorbent 20 are not held down actually. In this way, the entire area, which should be pressed, is pressed down by use of the designated portions of the cross ribs, not necessarily pressed down by ribs themselves (in FIG. 1, being pressed by the designated intervals resultantly), hence making it possible to reduce the area occupied by the ribs, while obtaining the effect that the buffer space is made larger.

As described above, the ink tank of the present embodiment makes it possible to prevent the rib 1 from entering the ink absorbent 20 as if to pierce it, and also, prevent the reduction of the volume of the buffer space. Then, the ribs press the ink absorbent appropriately to make the preciseness of pressure adjustment in the ink tank higher. Also, the use efficiency of ink is enhanced. Further, even with the rib 1, which is formed thin and long, it is possible to prevent the position of an ink absorbent 20 from shifting, as well as to prevent the rib 1 from being damaged even if shocks are given due to the drop of an ink tank or the like.

Here, for the structure of the present invention, it is preferable to provide intersecting points from the viewpoint of the enhancement of strength as described above. However, it is to be understood that the structure from which the intersecting points are removed is also the one that falls within the scope of the invention. With the removal of the intersecting points, the adjacent buffer spaces, which are set apart by ribs, are communicated to enhance the function as the buffer space still more, and also, enhance the capability of ink supply, because the air is supplied over in a good condition. Even with the rib structure, from which intersecting points are removed, the strength thereof is almost equal, and there is no problem as to the fall down of ribs, because the ribs are not very long.

Next, with reference to FIG. 3 to FIG. 8, the description will be made of the example in which the aforesaid ink tank of the present embodiment is installed on the ink jet cartridge for use of an ink jet recording apparatus.

Figure 3:
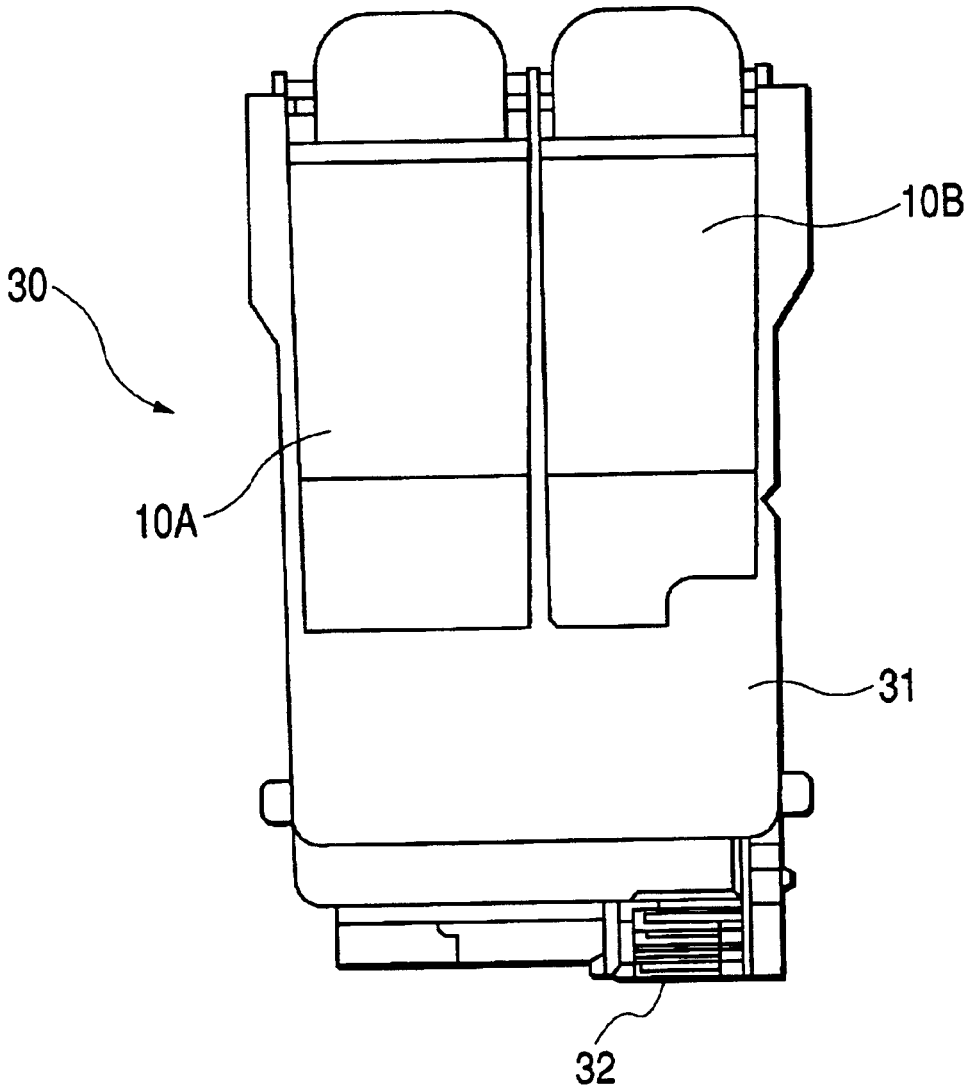
FIG. 3 is a front view that shows an ink jet cartridge, which installs the ink tanks of the present invention.

FIG. 3 is a front view that shows the ink jet cartridge having the ink tank of the present embodiment installed thereon. In FIG. 3, the ink jet cartridge 30 comprises a holder 31 integrally formed with the ink jet head 32 that discharges ink; and a black ink tank 10B and a color ink tank 10A detachably held on this holder 31. The black ink tank 10B and the color ink tank 10A are the ink tanks having the structure of the present invention, respectively. These ink tanks contain ink to be supplied to the ink jet head 32, and the black ink tank 10B contains black (B) ink, and the color ink tank 10A contains ink of three colors, yellow (Y), cyan (C), and magenta (M).

The ink jet head 32 is positioned on the bottom of the holder 31 in a state of being used, and provided with plural discharge port groups (not shown) corresponding to ink of each color to be supplied from the black ink tank 10B and color ink tank 10A. For the connecting portion of the black ink tank 10B and the connecting portion of the color ink tank 10A of the holder 31, plural ink induction tubes (not shown) are arranged to extrude corresponding to ink of each color. Each of the ink induction tubes is connected with the corresponding discharge port group through the respective ink supply paths (not shown).

When the black ink tank 10B is installed on the holder 31, black ink in the black ink tank 10B is supplied to the discharge port group for use of black ink through the ink induction tube and ink supply path for use of black ink. Likewise, when the color ink tank 10A is installed on the holder 31, ink of each color in the color ink tank 10A is supplied to the corresponding discharge port groups for the corresponding color use through the ink induction tubes and ink supply paths for use of color ink use.

For the leading end of each ink induction tube, a filter (not shown) is provided respectively in order to prevent foreign substances from entering the ink induction tube.

Figure 4A:
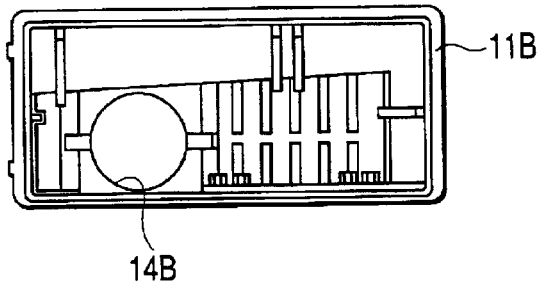
FIGS. 4A, 4B, and 4C are plan view, side view, and bottom view that illustrate a black ink tank of the ink jet cartridge shown in FIG. 3, respectively.
Figure 4B:
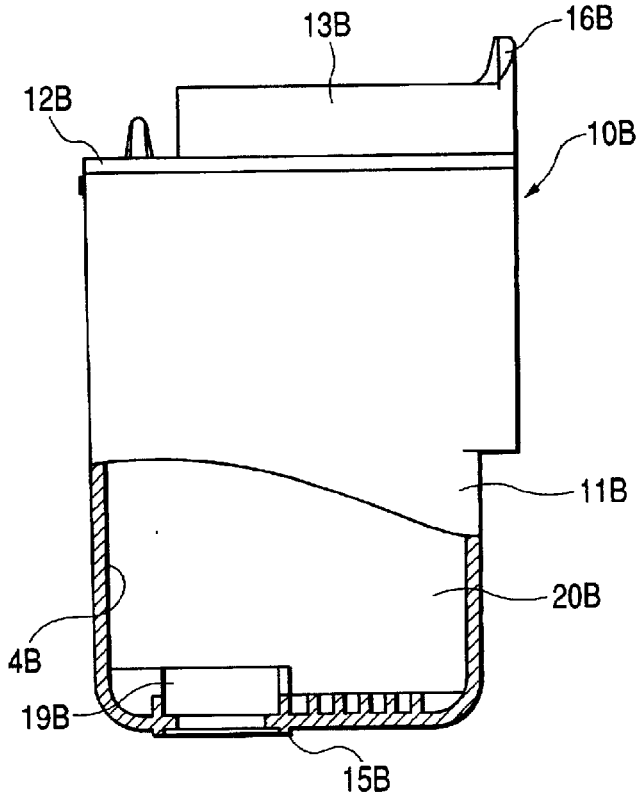
Figure 4C:
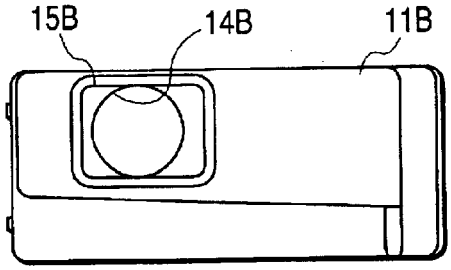
Figure 5:
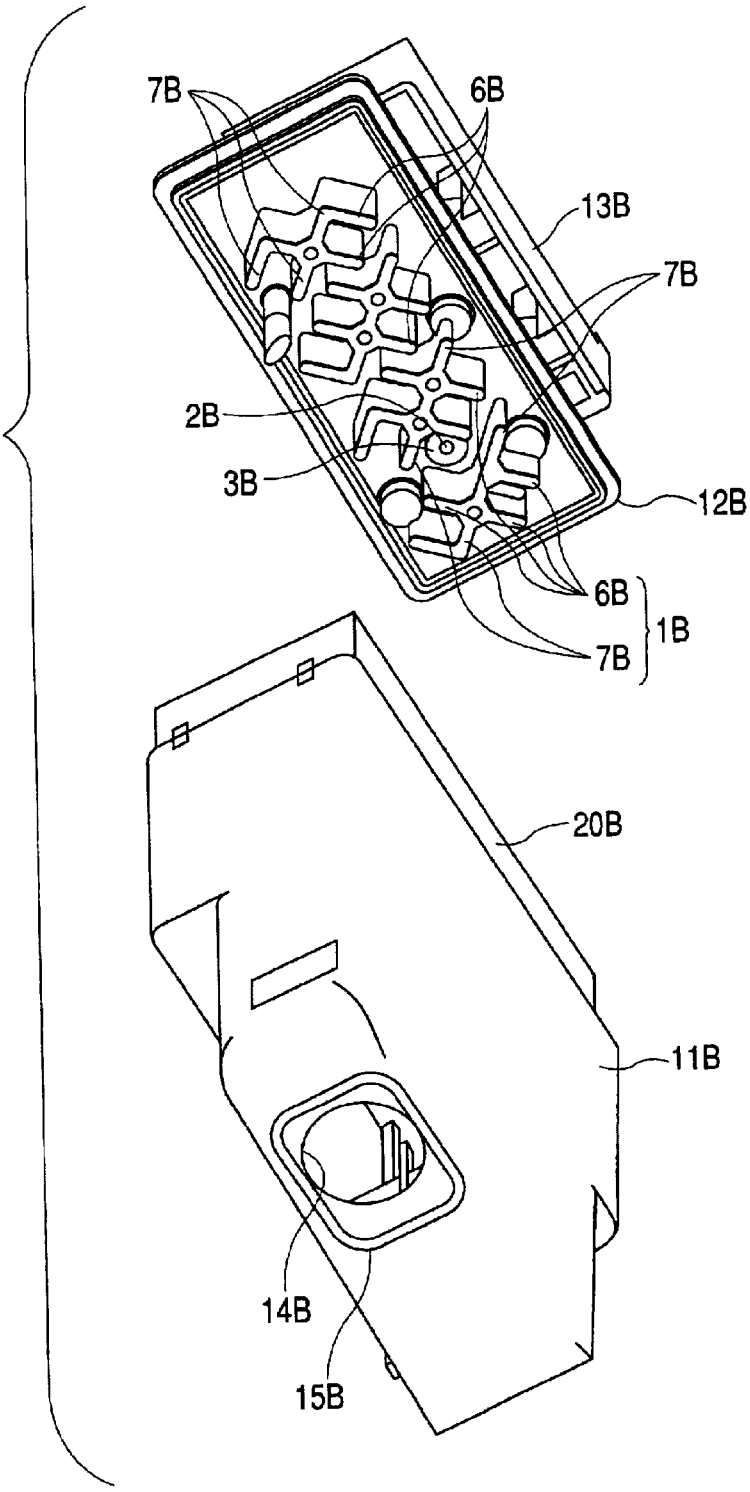
FIG. 5 is an exploded perspective view that shows the black ink tank represented in FIGS. 4A, 4B, and 4C.
Figure 6:
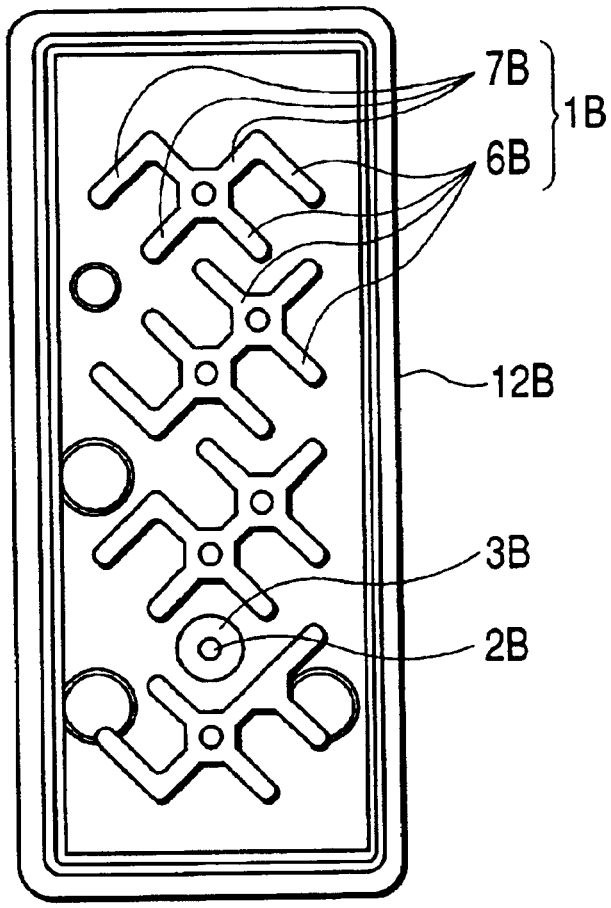
FIG. 6 is an enlarged plan view that shows the cover member of the black ink tank represented in FIGS. 4A, 4B, and 4C.

Here, with reference to FIGS. 4A through 4C to FIG. 6, the black ink tank 10B will be described. FIGS. 4A, 4B, and 4C are views that illustrate the black ink tank 10B shown in FIG. 3. FIG. 4A is the plan view thereof. FIG. 4B is the partially broken side view thereof. FIG. 4C is the bottom view thereof. In this respect, FIG. 4A shows the state where the cover member and the ink absorbent are removed. FIG. 5 is the exploded perspective view of the black ink tank 10B. FIG. 6 is the plan view that shows the inner wall portion of the cover member of the black ink tank 10B.

The black ink tank 10B forms the containing portion 4B for use of black ink use, comprises the housing 11B the upper edge of which is the opening portion thereof; the cover member 12B closing the opening portion of the housing 11B, which is provided with the atmosphere communication port 2B (see FIG. 5 and FIG. 6); and the upper member 13B installed to cover the atmosphere communication port 2B of the cover member 12B, which is provided with the inner space for buffering use to prevent ink leakage from the atmosphere communication port 2B from flowing externally. For the upper member 13B, an air releasing port (not shown) is formed on a position different from the position where the atmosphere communication port 2B of the cover member 12B is arranged, while the nipping portion 16B is provided for this member to be utilized when attached to or detached from the holder 31 (see FIG. 3).

On the bottom portion of the housing 11B, an ink supply port 14B is formed for the holder 31 on a position facing the ink induction tube for black ink use when the black ink tank 10B is installed on the holder 31. On the circumference of the ink supply port 14B, a flange 15B is formed to prevent ink from leaking into the holder 31 when ink is supplied from the black ink tank 10B through the ink induction tube.

In the containing portion 4B, the ink absorbent 20B, which impregnates black ink, is contained. Also, between the ink absorbent 20B and the bottom wall of the black ink tank 10B, an ink outlet member 19B is provided to be closely in contact with the ink absorbent 20B, which closes the ink supply port 14B from inside. The ink outlet member 19B also impregnates and retains ink as the ink absorbent 20B. However, the ink retaining force of the ink outlet member 19B is made higher than the ink retaining force of the ink absorbent 20B. In this manner, ink retained in the ink absorbent 20B is led to the ink outlet member 19B effectively to enhance the efficiency of consumption of ink retained in the ink absorbent 20B.

When the black ink tank 10B is installed on the holder 31, the ink induction tube is in contact with the ink outlet member 19B in the ink supply port 14B, and ink retained by the ink outlet member 19B is supplied to the discharge port group of the ink jet head 32 through the ink induction tube and ink supply path for black ink use.

Although not shown in precisely in FIGS. 4A to 4C and FIG. 5, the ink absorbent 20B of this black ink tank 10B is the fibrous lamination member having web (fibers) of polypropylene and polyethylene fiber material laminated as the ink absorbent 20 shown in FIG. 1 and FIG. 2.

As shown in FIG. 5 and FIG. 6, the cover member 12B of the black ink tank 10B is provided with the rib 1B that extrudes vertically from the inner wall portion into the containing portion 4B as the cover member 12 shown in FIG. 1 and FIG. 2 previously. The rib 1B is formed by a first directional rib 6B and a second directional rib 7B, which intersect with each other. The first directional rib 6B is arranged so that the angle thereof becomes 45 degrees to the direction parallel to the fibrous lamination surface of the ink absorbent 20B. The second directional rib 7B is arranged to be orthogonal to the first directional rib 6B. Also, on a position of the cover member 12B, which is surrounded by the first directional rib 6B and the second directional rib 7B, the atmosphere communication port 2B is arranged. On the inner edge of the atmosphere communication port 2B, there arranged the communication port guide 3B that surrounds the atmosphere communication port 2B and extrudes to the inner side thereof. The height of the communication port guide 3B is smaller than that of the rib 1B.

Figure 7A:
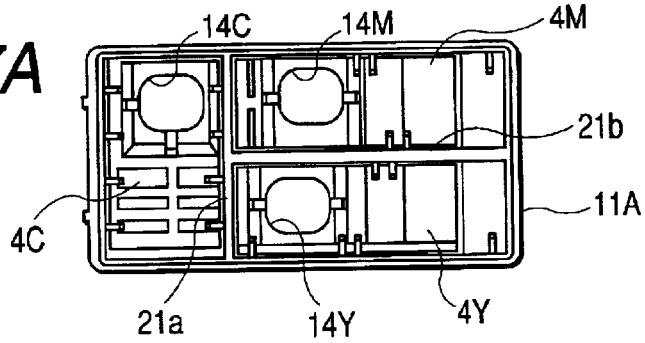
FIGS. 7A, 7B, and 7C are plan view, side view, and bottom view that illustrate a color ink tank of the ink jet cartridge shown in FIG. 3, respectively.
Figure 7B:
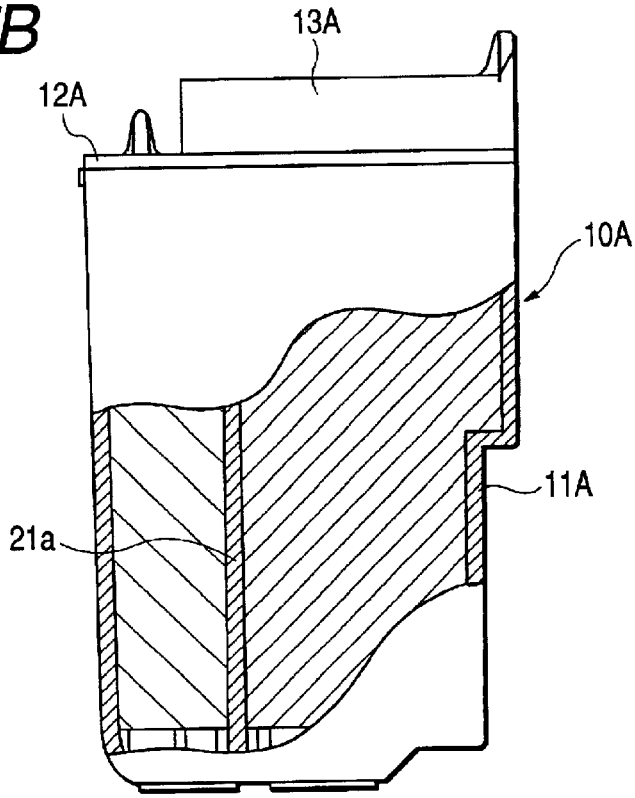
Figure 7C:
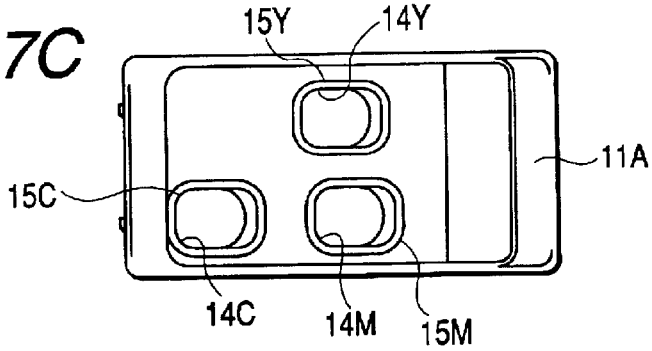
Figure 8:
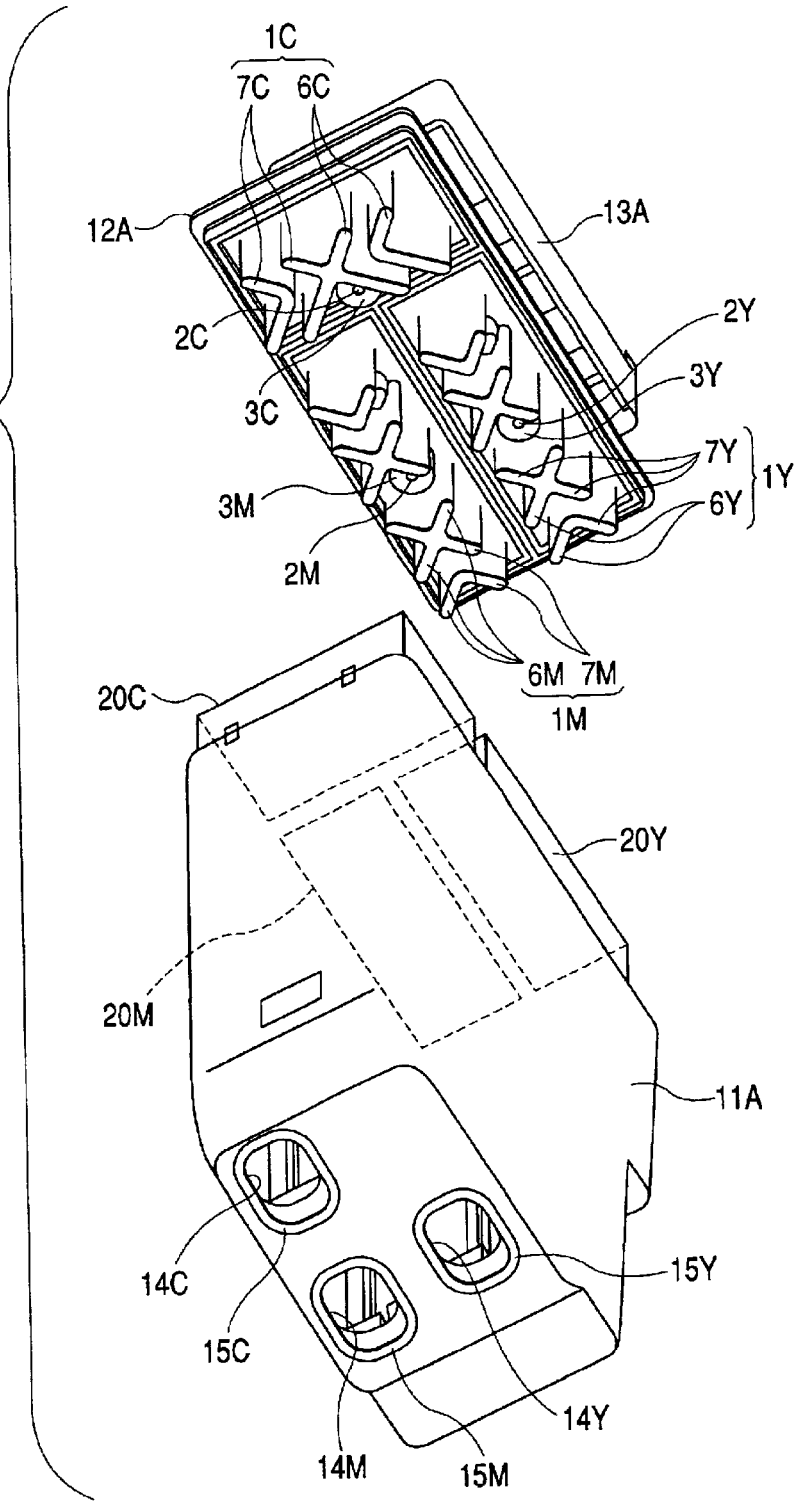
FIG. 8 is an exploded perspective view that shows the color ink tank represented in FIGS. 7A, 7B, and 7C.
Figure 9:
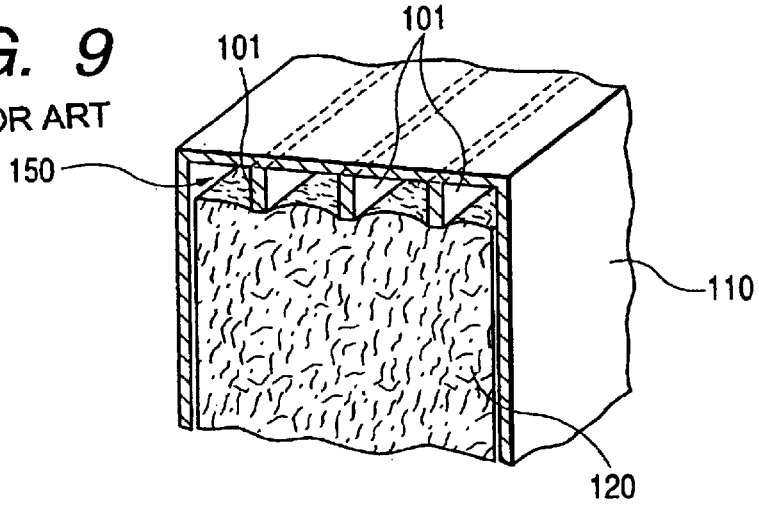
FIG. 9 PRIOR ART
FIG. 9 is a partially broken perspective view that shows the conventional ink tank.
Figure 10:
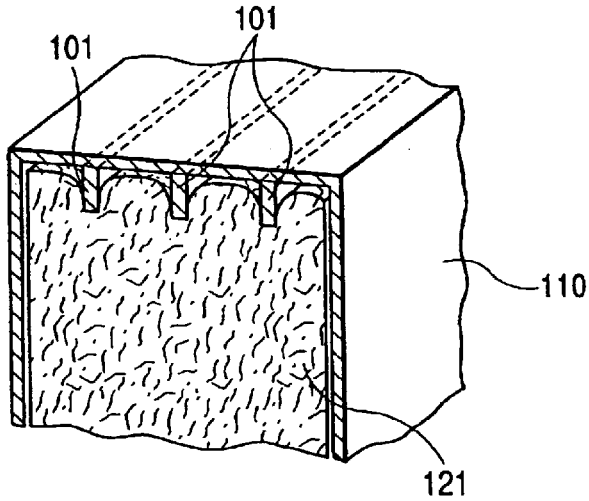
FIG. 10 PRIOR ART
FIG. 10 is a partially broken perspective view that shows another example of the conventional ink tank.
Figure 11:
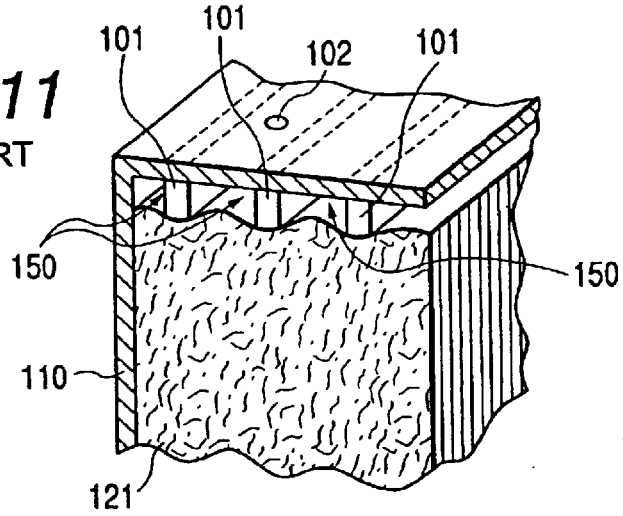
FIG. 11 PRIOR ART
FIG. 11 is a partially broken perspective view that shows still another example of the conventional ink tank.

Next, with reference to FIGS. 7A to 7C and FIG. 8, the color ink tank 10A will be described. FIGS. 7A, 7B, and 7C are views that illustrate the color ink tank 10A shown in FIG. 3. FIG. 7A is the plan view thereof. FIG. 7B is the partially broken side view thereof. FIG. 7C is the bottom view thereof. In this respect, FIG. 7A shows the state where the cover member and the ink absorbent are removed. FIG. 8 is the exploded perspective view of the color ink tank 10A.

Fundamentally, the color ink tank 10A has the same structure as the black ink tank 10B, which comprises the housing 11A that contains ink; the cover member 12A having atmosphere communication ports 2Y, 2C and 2M (see FIG. 8); and the upper member 13A installed on the cover member 12A.

The interior of the housing 11A is divided into three areas by use of the partition walls 21*a* and 21*b* arranged in the T-letter shape when observed from above corresponding to the positions of ink induction tubes of the holder 31. These become the containing portion 4Y for yellow ink use, the containing portion 4C for cyan ink use, and the containing portion 4M for magenta ink use. The atmosphere communication ports 2Y, 2C, and 2M of the cover member 12A are provided for each of containing portions 4Y, 4C, and 4M, respectively.

On the bottom portion of the housing 11A, ink supply ports 14Y, 14C, and 14M are formed for the holder 31 on positions facing the respective ink induction tubes when the black ink tank 10A is installed on the holder 31. On the circumference thereof, flanges 15Y, 15C and 15M are formed, respectively, to prevent ink leakage.

Also, in each interior of the containing portions 4Y, 4C, and 4M, each of the ink absorbents 20Y, 20C, and 20M, which impregnates the designated color ink, is contained (only upper face of the ink absorbent 20Y schematically shown), and also, each of the ink outlet portions (not shown) are arranged. The structure of each of them, and the ink supply operation of each containing portions 4Y, 4C,and 4M is the same as that of the black ink tank 10B.

The ink absorbents 20Y, 20C and 20M of the color ink tank 10A are the fibrous lamination members having web (fibers) of polypropylene and polyethylene fiber material laminated as the ink absorbent 20 shown in FIG. 1 and FIG. 2 and the ink absorbent 20B of the black ink tank 10B shown in FIGS. 4A to 4C and FIG. 5. Then, as the cover members 12 and 12B shown in FIGS. 1, 2, 5, and 6, the cover member 12A of the color ink tank 10A is provided with the ribs 1Y, 1C, and 1M extended vertically from the inner wall portion into the containing portion. These ribs 1Y, 1C and IM are formed by first directional ribs 6Y, 6C, and 6M each having the angle of 45 degrees to the direction parallel to the fibrous lamination surface of the ink absorbents 20Y, 20C, and 20M, and by the second directional ribs 7Y, 7C, and 7M, which are orthogonal to the first directional ribs 6Y, 6C, and 6M to intersect with them, respectively. Also on the respective positions, which are surrounded by the first directional ribs 6Y, 6C, and 6M and the second directional ribs 7Y, 7C, and 7M, there are arranged, respectively, the atmosphere communication ports 2Y, 2C, and 2M, and the communication port guides 3Y, 3C, and 3M, which surround the atmosphere communication ports 2Y, 2C and 2M and extrude internally. The heights of the communication port guides 3Y, 3C, and 3M are smaller than those of the ribs 1Y, 1C, and 1M.

In accordance with the present invention, it is possible to suppress the burying of ribs in ink absorbent and to secure the air passage for the containing portion of an ink tank for carrying the air evenly to the ink absorbent. Also, it is possible to press the ink absorbent exactly by use of the ribs, hence keeping the ink absorbent in the negatively pressurized condition desirably to make the pressure adjustment more precise in the ink tank and the use efficiency of ink higher accordingly.

Further, it becomes possible to keep the gap between the atmosphere communication port and the ink absorbent appropriately, as well as to secure the buffer space of a desirable volume, hence preventing ink from leaking to the outside of the ink tank.

Also, the rigidity of the rib is high despite the thin and long shape having a small area, thus preventing it from being broken, while suppressing the positional shift of the ink absorbent.

Further, the area that needs to be held down is not pressed by ribs totally, but such area is pressed by use of the designated portion of a cross rib (in a condition similar to the one where pressure is essentially exerted in a point). Then, it becomes possible to reduce the area to be occupied by the rib, thus obtaining the effect that the buffer space is made larger accordingly.

What is claimed is:

1. An ink tank for storing ink for supply to an ink jet head, the ink tank comprising:

a main body provided with an ink supply port and an atmosphere communication port provided respectively on first and second faces of said main body, wherein the first and second faces oppose one another;

an ink absorbent capable of storing ink contained in the main body and formed by stacked fibrous sheet material having a thickness such that the ink absorbent is containable in the main body, wherein a first lamination side surface of the ink absorbent faces the ink supply port and a second lamination side surface of the ink absorbent faces the atmosphere communication port; and a rib structure provided on the second face of the main body containing said atmosphere communication port, the rib structure projecting inward of the main body and comprising;

a first rib portion arrayed diagonally with respect to said second lamination side surface of said ink absorbent, and a second rib portion that intersects with said first rib portion and is arrayed diagonally with respect to said second lamination side surface of said ink absorbent wherein, said first and second rib portions have respective heights such that the atmosphere communication port is spaced apart from the second lamination side surface of said ink absorbent, and wherein, the first and second rib portions contact the second lamination side surface of the ink absorbent to press the ink absorbent toward the first face of the main body containing the ink supply port.

2. An ink tank according to claim 1, wherein said ink absorbent is formed by polypropylene.

3. An ink tank according to claim 1, wherein said ink absorbent is formed by polyethylene.

4. An ink tank according to claim 1, wherein the first rib portion and the second rib portion are partly connected with each other to form a substantially v shape, a substantially w shape, a substantially x shape, or a shape made by a combination thereof.

* * * * *

UNITED STATES PATENT AND TRADEMARK OFFICE

CERTIFICATE OF CORRECTION

PATENT NO. : 6,827,431 B2
DATED : December 7, 2004
INVENTOR(S) : Kenji Kitabatake et al.

It is certified that error appears in the above-identified patent and that said Letters Patent is hereby corrected as shown below:

Column 1,
Line 49, "air passage 15" should read -- air passage 150 --; and
Line 53, "air passages 15" should read -- air passages 150 --.

Column 2,
Line 54, "pace" should read -- space --.

Column 3,
Line 9, "selling" should read -- swelling --.

Column 5,
Line 25, "5 $\mu$m to 5 $\mu$m" should read -- 5 $\mu$m to 50 $\mu$m --.

Signed and Sealed this

Tenth Day of May, 2005

JON W. DUDAS
*Director of the United States Patent and Trademark Office*